United States Patent [19]

Golder et al.

[11] 4,102,106

[45] Jul. 25, 1978

[54] SIDING PANEL

[75] Inventors: Michael D. Golder, Waldwick; William M. Bernat, Garfield, both of N.J.

[73] Assignee: GAF Corporation, New York, N.Y.

[21] Appl. No.: 754,987

[22] Filed: Dec. 28, 1976

[51] Int. Cl.[2] ..... E04D 1/00

[52] U.S. Cl. ..... 52/533; 52/539; 52/546; 52/553

[58] Field of Search ..... 52/520, 533, 535, 539, 52/546, 529, 530, 531, 522, 523, 526, 553, 547, 548

[56] References Cited

U.S. PATENT DOCUMENTS

| | | | |
|---|---|---|---|
| 1,122,492 | 12/1914 | Galbraith | 52/522 |
| 1,519,350 | 12/1924 | Belding | 52/522 |
| 1,597,993 | 8/1926 | Meurer | 52/529 |
| 3,408,786 | 11/1968 | Snyker | 52/547 X |
| 3,473,274 | 10/1969 | Godes | 52/531 X |
| 3,504,467 | 4/1970 | Hatch et al. | 52/531 X |

*Primary Examiner*—Ernest R. Purser
*Assistant Examiner*—Carl D. Friedman
*Attorney, Agent, or Firm*—Walter C. Kehm; Joshua J. Ward

[57] ABSTRACT

A siding panel and siding panel assembly. Each panel has a pair of ridges near the top edge so that the top edge of the panel can be nailed to a substrate while remaining spaced therefrom. The bottom edge of each panel is provided with a flange terminating in an inverted U-shaped opening adapted to engage the upper edge of an adjacent panel.

7 Claims, 2 Drawing Figures

SIDING PANEL

BACKGROUND OF THE INVENTION

This invention relates to siding panels suitable for surfacing exterior walls and roofs of buildings. While conventional siding panels produced from thermo-plastic such as polyvinylchloride (PVC) are well known and have been manufactured in many various shapes, difficulties have continued to be encountered due to the fact that satisfactory profile designs frequently are difficult or expensive to manufacture. It is difficult for instance to extrude wide, nonuniform, unsymetric profiles from thermoplastics. Complex dies are required to produce a product of acceptable tolerance from a well-mixed uniform extrudate which contains a minimum of internal stresses. Furthermore, exacting coordination between the downstream profile shaping equipment and die operation must be maintained to make marketable products. Hence, output from an extrusion process for complex profiles is significantly below the output for profiles of uniform, symetrical shape. Nonsymetrical shapes also increase the difficulty of laminating plastic film to siding panels. Conventional siding must also be installed by pressing each panel upwardly into place while the upper portion of the panel is nailed to the substrate. Conventional siding panels and panel assemblies of the type referred to above and which are subject to the disadvantages mentioned above include for instance those described in U.S. Pat. Nos. 3,473,274, 3,552,078, 3,520,099 etc.

SUMMARY OF THE INVENTION

It is an object of the present invention to provide siding panels which are easily manufactured and installed and are not subject to the various disadvantages mentioned above. In accordance with the invention, an elongated siding panel is provided which has first and second longitudinally extending edge portions and first and second surfaces.

A first pair of parallel, spaced ridges is provided on the first surface of the first edge portion of the panel. The first pair of ridges is adjacent to but spaced from the edge of such edge portion and is parallel therewith. A flange extends from the first surface of the second edge portion adjacent the edge of the second edge portion. The flange terminates in a generally U-shaped opening which is coplanar with the first edge portion of the panel and which opens in a direction away from the first edge portion. In a preferred embodiment, a second pair of spaced parallel ridges is positioned on the second surface of the panel parallel with and opposite the first pair of ridges.

The invention also provides a lapped siding assembly comprising a plurality of lapped, elongated horizontal siding panels of the type described above on a generally vertical substrate. The U-shaped opening of a flange connected to the bottom edge of each panel engages the upper edge portion of the next lower adjacent panel of the assembly.

DETAILED DESCRIPTION OF THE INVENTION

As mentioned above, the invention includes individual siding panels and a siding panel assembly utilizing such panels. While panels of the invention may be constructed from any suitable materials, the invention is particularly applicable to rigid plastic building panels manufactured from conventional thermoplastic materials such as polyolefin (e.g. polyethylene), polycarbonate, polyvinyl chloride (PVC), polyvinyl flouride, acrylic resins, acrylonitrile, butadiene, styrene, copolymers of acrylonitrile, butadiene and styrene (ABS), etc. PVC is a preferred plastic for the panels of the invention. While rigid plastics are preferred, other materials such as metals may be used.

The panels of the invention may be constructed by any suitable conventional techniques. Profile extrusion is preferred since this is an economical manufacturing technique and the design of the panels of the invention is readily adaptable to this method of manufacture. Other manufacturing techniques suitable for manufacture of panels of the invention include, for instance, conventional vacuum forming operations as well as the air system described in U.S. Pat. No. 3,776,672.

A particularly desirable embodiment of the invention is an extruded profile of the thermoplastic material containing a filler such as calcium carbonate, talc, asbestos, glass fibers, silicates, wood flour or any other suitable material. Also panels of the invention can be laminated with films such as polyvinyl flouride, acrylics, etc. in a conventional manner to improve weatherability.

As will be apparent from the more detailed description of the invention given below, panels of the invention can be installed to form lapped siding assemblies much more easily than more conventional siding products having more complicated profiles. Also the design of the panels of the invention allows a greater range of thermoplastic materials to be used with the same design, since die design is not as critical as with more complicated profiles.

For a more complete understanding of the invention reference may be had to the drawings which show a lapped siding assembly 10 comprising a substrate 12 and a plurality of panels 14 constructed in accordance with the invention and fastened to the substrate by fastener means in the form of conventional nails 16.

Figure 1:
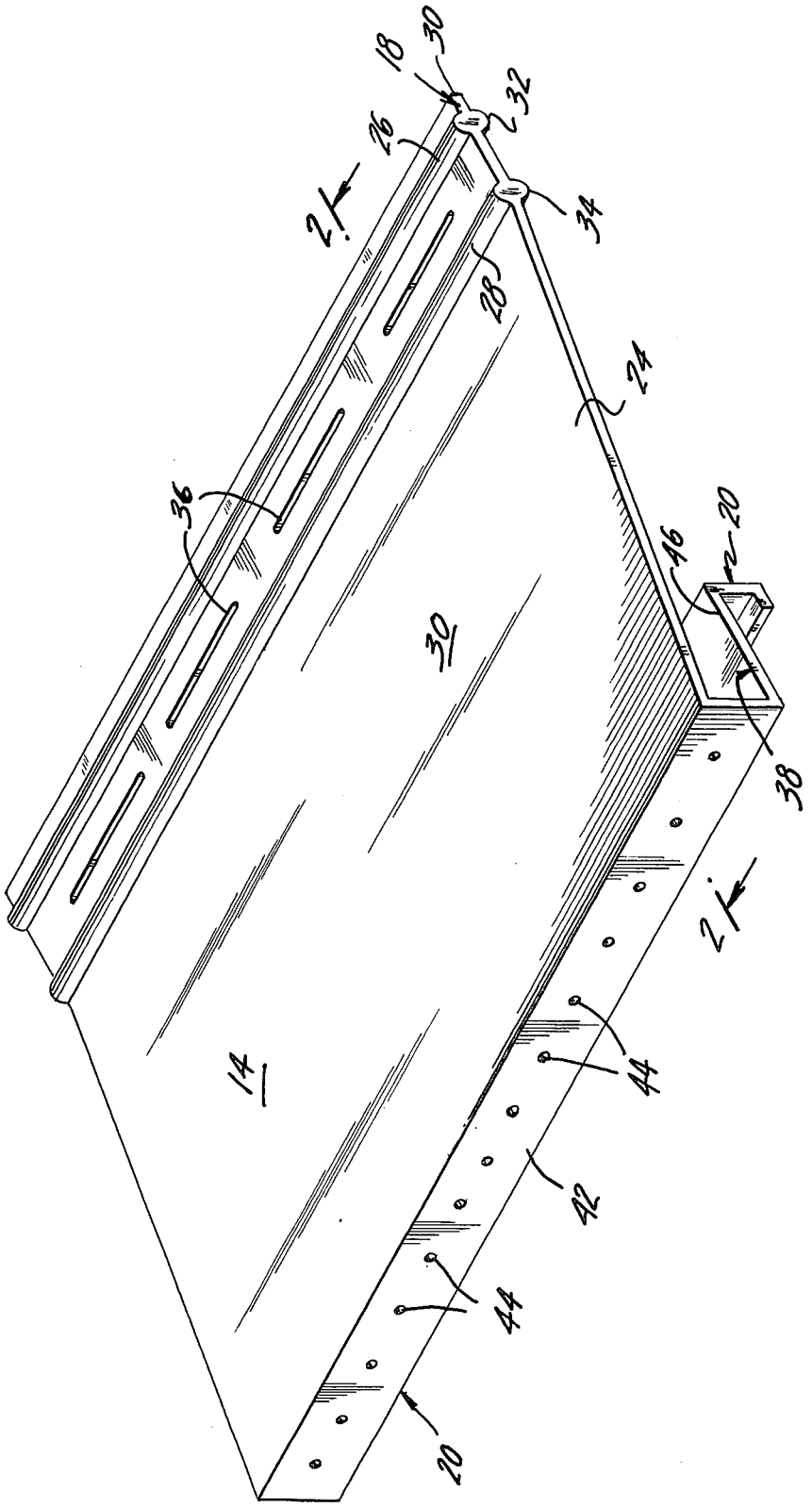
FIG. 1 is an isometric view showing a typical building panel constructed in accordance with the invention.

As indicated in the drawings, each of the panels 14 has first and second longitudinally extending edge portions indicated generally as upper and lower edge portions 18 and 20 respectively and first and second surfaces indicated as inner and outer surfaces 22 and 24 respectively. Each panel has a first pair of parallel, spaced ridges 26 and 28 adjacent to but spaced from the upper edge 30 of the panel. A second pair of spaced, parallel ridges 32 and 34 is provided on the inner surface 22 opposite the ridges 26 and 28. As can be seen from FIG. 2, the nails 16 extend through slots 36 (best shown in FIG. 1), the heads of the nails being flush with the tops of the ridges 26 and 28.

Figure 2:
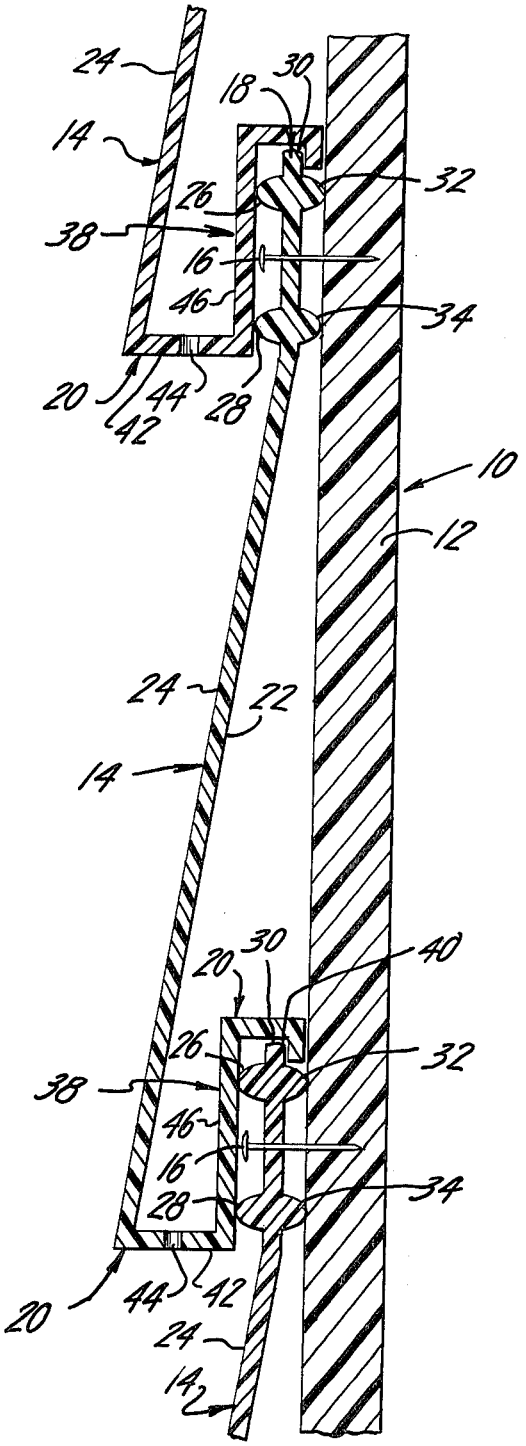
FIG. 2 is a sectional view taken as indicated by line 2—2 of FIG. 1.

The outer surface 24 of each panel 14 extends downwardly and outwardly with respect to the substrate 12 from the upper edge portion 18 of the panel to the lower edge portion 20 thereof. As best shown in FIG. 2, the lower edge portion 20 of each panel includes a flange, indicated generally at 38, extending from the inner surface 22 of the panel and terminating in an inverted, generally U-shaped opening 40. The U-shaped opening 40 is coplanar with the upper edge portion 18 of the panel and engages the upper edge portion 18 of the adjacent lower panel in the siding assembly. The flange 38 further includes a generally horizontal member 42 which may contain conventional weep holes 44. The flange also includes a vertical portion 46 which is directly adjacent to and overlaps substantially the entire outer surface 24 of the upper edge portion of the next lower panel in the siding assembly, the upper edge of which is engaged by the U shaped opening 40.

While the invention has been described above with respect to preferred embodiments thereof, it will be understood that various changes and modifications may be made without departing from the spirit and scope of the invention.

What we claim is:

1. An elongated siding panel having first and second longitudinally extending edge portions and first and second surfaces, and further comprising:

(a) a first pair of parallel, spaced ridges on the first surface of the first edge portion of said panel, said ridges being adjacent to but spaced from the edge of said first edge portion and being parallel therewith;

(b) a second pair of spaced parallel ridges, said second pair of ridges being positioned on the second surface of the panel opposite and parallel with the first pair of ridges; and (c) a flange extending from the first surface of the second edge portion of said panel adjacent the edge of the second edge portion, said flange terminating in a generally U shaped opening which is coplanar with the first edge portion of the panel and which opens in a direction away from said first edge portion.

2. A lapped siding assembly comprising a plurality of lapped, elongated horizontal siding panels on a generally vertical substrate, each panel comprising a body portion having generally horizontal and parallel top and bottom edge portions and having inner and outer surfaces, each panel being further characterized by:

(a) the upper edge portion of each panel having a first pair or parallel, spaced ridges on the inner surface thereof adjacent the substrate, said ridges being adjacent to but spaced from the upper edge of the upper edge portion of the panel and parallel with said upper edge; and (b) the lower edge portion of each panel having a flange extending from the inner surface of the panel and terminating in a inverted U shaped opening in engagement with the upper edge portion of an adjacent panel of the assembly, said parallel ridges being positioned so as to space the upper edge of the panel from the substrate sufficiently to allow engagement of the upper edge of the panel with the U shaped opening of an adjacent panel of the assembly.

3. A siding assembly according to claim 2, in which the upper edge portion of each panel further comprises a second pair of spaced parallel ridges positioned on the outer surface of the panel opposite the first pair of ridges.

4. A siding assembly according to claim 3, in which the flange extending from the lower edge portion of each panel includes a vertical portion adjacent to and overlapping substantially the entire outer surface of the upper edge portion of the adjacent panel engaged by the U shaped opening of the flange.

5. A siding assembly according to claim 4 in which the outer surface of each panel includes a face portion extending downwardly and outwardly from the upper edge portion to the lower edge portion thereof.

6. A siding assembly according to claim 5 in which each panel is formed of a single piece of material.

7. A siding assembly according to claim 5 in which each panel has a series of longitudinally elongated slots, each such slot extending through the panel between the ridges of each of the first and second pair of ridges, with drive fastener means through such slots affixing the panels of the assembly to the substrate of the assembly, the fastener means being driven into the substrate to an extent that the outermost portion of the fastener means is substantially coplanar with the outer edges of the second pair of ridges.

* * * * *